US012134538B2

(12) United States Patent
Kishimoto

(10) Patent No.: US 12,134,538 B2
(45) Date of Patent: Nov. 5, 2024

(54) SHEET DISCHARGE DEVICE AND SHEET POSTPROCESSING DEVICE PROVIDED THEREWITH

(71) Applicant: KYOCERA Document Solutions Inc., Osaka (JP)

(72) Inventor: Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 136 days.

(21) Appl. No.: 18/185,957

(22) Filed: Mar. 17, 2023

(65) Prior Publication Data

US 2023/0303356 A1 Sep. 28, 2023

(30) Foreign Application Priority Data

Mar. 24, 2022 (JP) ..... 2022-047898

(51) Int. Cl.
*B65H 31/26* (2006.01)
*B65H 31/02* (2006.01)
(Continued)

(52) U.S. Cl.
CPC ..... *B65H 31/26* (2013.01); *B65H 31/02* (2013.01); *B65H 43/06* (2013.01); *B65H 43/08* (2013.01); *B65H 45/18* (2013.01); *B65H 45/00* (2013.01); *B65H 2301/17* (2013.01); *B65H 2402/31* (2013.01); *B65H 2403/942* (2013.01); *B65H 2404/612* (2013.01); *B65H 2404/64* (2013.01); *B65H 2404/693* (2013.01); *B65H 2405/11151* (2013.01); *B65H 2511/15* (2013.01); *B65H 2553/414* (2013.01); *B65H 2553/80* (2013.01); *B65H 2701/1123* (2013.01);
(Continued)

(58) Field of Classification Search
CPC .... B65H 31/26; B65H 2511/15; B65H 43/06; B65H 45/00; B65H 2553/80; B65H 2701/11238; B65H 2701/1123; B65H 2701/11231; B65H 2701/11232; B65H 2701/11234; B65H 2701/1125; B65H 2701/11252
See application file for complete search history.

(56) References Cited

U.S. PATENT DOCUMENTS 7,866,647 B2 * 1/2011 Terao ..... B65H 31/26 270/58.11

FOREIGN PATENT DOCUMENTS

JP 2002-255431 A 9/2002
JP 2009-062111 A 3/2009

* cited by examiner

*Primary Examiner* — Jeremy R Severson
(74) *Attorney, Agent, or Firm* — Stein IP LLC

(57) ABSTRACT

The sheet discharge device includes: a sheet discharge part; a sheet discharge tray having a tray upper surface and a rear wall portion; a fullness detection sensor for detecting that a height of a stack surface of folded sheets; and a first sheet presser member and a second sheet presser member for pressing a rear end side and a fore end side in a discharge direction, of the folded sheet. In a first pressing position in which the first sheet presser member extends from above the detection sensor to below the detection region, and is brought into contact with the folded sheet of a minimum size stacked on the tray upper surface. When a stack number of the folded sheets has exceeded a specified number, the first sheet presser member is retracted upward from the first pressing position by the rise of the stack surface.

13 Claims, 7 Drawing Sheets

(51) Int. Cl.

| | |
|---|---|
| ***B65H 43/06*** | (2006.01) |
| ***B65H 43/08*** | (2006.01) |
| ***B65H 45/18*** | (2006.01) |
| *B65H 45/00* | (2006.01) |

(52) U.S. Cl.
CPC ..... *B65H 2701/11232* (2013.01); *B65H 2701/11234* (2013.01); *B65H 2701/11238* (2013.01); *B65H 2801/27* (2013.01)

SHEET DISCHARGE DEVICE AND SHEET POSTPROCESSING DEVICE PROVIDED THEREWITH

INCORPORATION BY REFERENCE

This application is based on and claims the benefit of priority from Japanese Patent Application No. 2022-047898 filed on Mar. 24, 2022, the contents of which are hereby incorporated by reference.

BACKGROUND

The present disclosure relates to a sheet discharge device for discharging sheets subjected to a folding process by which a sheet gets a fold or folds formed therein, and also relates to a sheet postprocessing device provided with the sheet discharge device.

There has been known heretofore a sheet postprocessing device provided with a sheet folding device that executes a folding process for forming a fold or folds on a sheet previously subjected to image formation by an image forming apparatus such as a copier and a printer.

SUMMARY

A sheet discharge device according to one aspect of the present disclosure includes a sheet discharge part, a sheet discharge tray, a fullness detection sensor, a first sheet presser member, and a second sheet presser member. The sheet discharge part includes a discharge roller pair for discharging a folded sheet subjected to a folding process. The sheet discharge tray includes a tray upper surface on which the folded sheet discharged from the sheet discharge part is stacked, and a rear wall portion rising from an upstream-side end portion of the tray upper surface in the discharge direction. The fullness detection sensor is provided in the sheet discharge part to detect that a height of a stack surface of the folded sheets stacked on the tray upper surface has reached a specified height. The fullness detection sensor is located in a detection position in a widthwise direction perpendicular to the discharge direction, and has a detection region which has a specified width in a heightwise direction. The first sheet presser member is supported upward of the sheet discharge part, and extends toward the upstream side of the tray upper surface in the discharge direction, and the folded sheet discharged from the sheet discharge part is brought into contact with the first sheet presser member, and moreover the first sheet presser member presses the rear end side of the folded sheet stacked on the tray upper surface in the discharge direction. The second sheet presser member is supported upward of the sheet discharge part, extends toward a downstream side of the tray upper surface in the discharge direction, and presses a discharge-direction fore end side of the folded sheet stacked on the tray upper surface. The first sheet presser member is disposed outside the fullness detection sensor in the widthwise direction, extends from above the detection region to below the detection region. In a first pressing position with a fore end portion of the first sheet presser member facing upward of the stack surface, the first sheet presser member is brought into contact with an arbitrary position in a range from a central portion of the folded sheet of a minimum size stacked on the tray upper surface in the discharge direction to the rear wall portion, thereby pressing a swell of the folded sheet. When a stack number of the folded sheets has exceeded a specified number, the first sheet presser member is retracted upward from the first pressing position by the rise of the stack surface.

DETAILED DESCRIPTION

Figure 1:
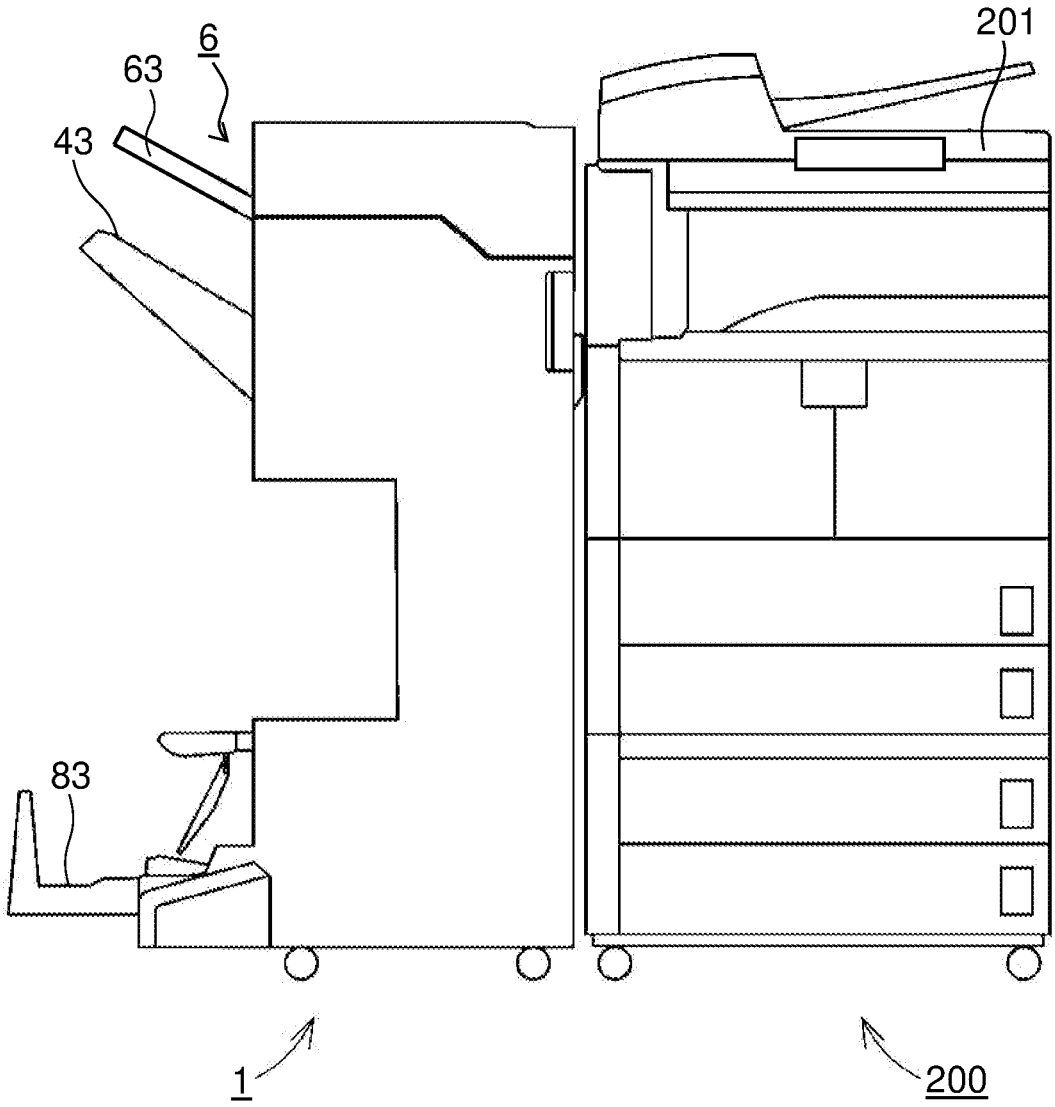
FIG. 1 is a schematic view showing a configuration of an image forming system which consists of: a sheet postprocessing device including a second sheet discharge part as an example of the sheet discharge device according to the present disclosure; and an image forming apparatus to which the sheet postprocessing device is coupled.

Hereinbelow, an embodiment of the present disclosure will be described in detail with reference to the accompanying drawings. FIG. 1 is a schematic view showing a configuration of an image forming system which consists of: a sheet postprocessing device 1 including a second sheet discharge part 6 as an example of the sheet discharge device according to the present disclosure; and an image forming apparatus 200 to which the sheet postprocessing device 1 is coupled.

The image forming apparatus 200, as shown in FIG. 1, prints out an image on a sheet (paper) based on image data inputted from external via an unshown network communication part or image data read by an image reading part 201 placed at a top of the image forming apparatus 200.

The sheet postprocessing device 1 is removably coupled to a side face of the image forming apparatus 200. The sheet postprocessing device 1 performs such postprocessing as a punch-hole forming process, a stapling process and a folding process on a sheet previously subjected to image formation (printing) by the image forming apparatus 200. It is noted that the sheet postprocessing device 1 is not limited to one which performs the postprocessing on a sheet automatically conveyed from the image forming apparatus 200, and may be one which allows a user to set a sheet on an unshown tray, the sheet then being conveyed up to a postprocessing-enabled position by the apparatus itself and subjected to the postprocessing.

Figure 2:
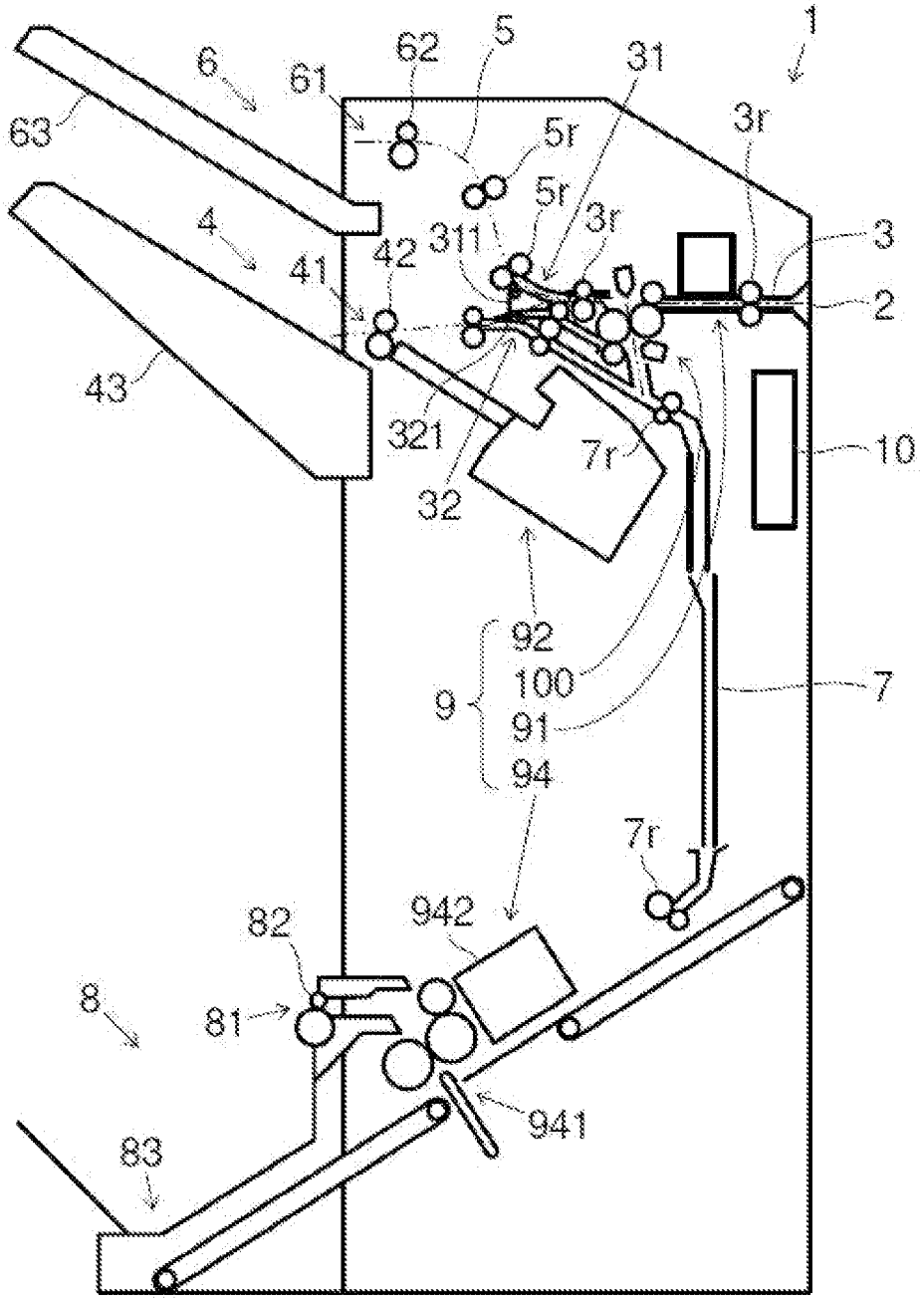
FIG. 2 is a side sectional view schematically showing a configuration of the sheet postprocessing device including the second sheet discharge part.

FIG. 2 is a side sectional view schematically showing a configuration of the sheet postprocessing device 1 including the second sheet discharge part 6. The sheet postprocessing device 1, as shown in FIG. 2, includes a sheet inlet 2, a first sheet conveyance path 3, a first sheet discharge part 4, a second sheet conveyance path 5, the second sheet discharge part 6, a third sheet conveyance path 7, a third sheet discharge part 8, a postprocessing part 9, and a postprocessing control part (control part) 10.

The sheet inlet 2 is an opening provided in a side face of the sheet postprocessing device 1 facing the image forming apparatus 200. A sheet conveyed from the image forming apparatus 200 toward the sheet postprocessing device 1 is conveyed through the sheet inlet 2 to get inside the sheet postprocessing device 1.

The first sheet conveyance path 3 extends from the sheet inlet 2 to the first sheet discharge part 4 in such a generally horizontal direction (leftward direction in FIG. 2) as to become farther from the image forming apparatus 200. It is noted that a direction from the sheet inlet 2 toward the first sheet discharge part 4 is referred to as a sheet conveyance direction of the first sheet conveyance path 3. The sheet inlet 2 is located at an upstream end of the first sheet conveyance path 3 in the sheet conveyance direction. The first sheet conveyance path 3, having thereon a plurality of conveyance roller pairs 3*r*, conveys the sheet, which has been conveyed through the sheet inlet 2 into the sheet postprocessing device 1, downstream in the sheet conveyance direction.

The first sheet discharge part 4 is provided on a side face of the sheet postprocessing device 1 opposite to its side face facing the image forming apparatus 200. The first sheet discharge part 4 is placed at a downstream end of the first sheet conveyance path 3 in the sheet conveyance direction. The first sheet discharge part 4 includes a first discharge port 41, a first discharge roller pair 42, and a first discharge tray 43.

The first discharge port 41 is located at a downstream end of the first sheet conveyance path 3 in the sheet conveyance direction. The first discharge roller pair 42 is placed at the first discharge port 41. The first discharge tray 43 is located on a downstream side of the first discharge port 41 in the sheet conveyance direction. A sheet conveyed along the first sheet conveyance path 3 and having reached the first discharge port 41 is passed through the first discharge port 41 by the first discharge roller pair 42 so as to be discharged onto the first discharge tray 43. The first discharge tray 43 is one of terminal discharge places for sheets subjected to the postprocessing by the sheet postprocessing device 1. Also discharged to the first discharge tray 43 are sheets subjected to no postprocessing, sheets of small sizes, and the like.

The second sheet conveyance path 5, branching from a first branch portion (branch portion) 31 on the first sheet conveyance path 3, extends up to the second sheet discharge part 6 in such a horizontal direction as to become farther (leftward direction in FIG. 2) from the image forming apparatus 200, as well as in an upward direction. The first branch portion 31 is placed downstream of a punching portion 91 in the sheet conveyance direction of the first sheet conveyance path 3. It is noted that a direction from the first branch portion 31 toward the second sheet discharge part 6 is referred to as a sheet conveyance direction of the second sheet conveyance path 5. The first branch portion 31 is located at an upstream end of the second sheet conveyance path 5 in the sheet conveyance direction. The second sheet conveyance path 5, having a plurality of conveyance roller pairs 5*r*, leads a sheet, which is under conveyance on the first sheet conveyance path 3, such that the sheet branches at the first branch portion 31 so as to be conveyed toward the second sheet discharge part 6.

The first branch portion 31 includes a first switching guide 311. The first switching guide 311 turns between a first position (broken line P1 in FIG. 5) in which a sheet conveyed on the first sheet conveyance path 3 from the sheet inlet 2 side is guided along the first sheet conveyance path 3 to the first discharge port 41, and a second position (solid line P2 in FIG. 5) in which the sheet is made to branch from the first sheet conveyance path 3 so as to be led to the second sheet conveyance path 5. The first switching guide 311 further turns to a third position (broken line P3 in FIG. 5) in which a sheet subjected to a folding process and having passed through a later-described second folding conveyance path 106 is led to the second sheet conveyance path 5. The first switching guide 311 is connected to a drive mechanism (not shown) and controlled in its operation by the postprocessing control part 10.

The second sheet discharge part 6 is provided upward of the first sheet discharge part 4 and on the side face of the sheet postprocessing device 1 opposite to its side face facing the image forming apparatus 200. The second sheet discharge part 6 is placed at a downstream end of the second sheet conveyance path 5 in the sheet conveyance direction. The second sheet discharge part 6 includes a second discharge port 61, a second discharge roller pair 62, and a second discharge tray 63.

The second discharge port 61 is located at a downstream end of the second sheet conveyance path 5 in the sheet conveyance direction. The second discharge roller pair 62 is placed at the second discharge port 61. The second discharge tray 63 is located on a downstream side of the second discharge port 61 in the sheet conveyance direction. A sheet conveyed along the second sheet conveyance path 5 and having reached the second discharge port 61 is passed through the second discharge port 61 by the second discharge roller pair 62 so as to be discharged onto the second discharge tray 63. The second discharge tray 63 is one of terminal discharge places for sheets subjected to postprocessing by the sheet postprocessing device 1.

The third sheet conveyance path 7, branching from a second branch portion 32 on the first sheet conveyance path 3, extends downward to reach the third sheet discharge part 8. It is noted that a direction from the second branch portion 32 toward the third sheet discharge part 8 is referred to as a sheet conveyance direction of the third sheet conveyance path 7. The second branch portion 32 is located on a downstream side of the first branch portion 31 as viewed in the sheet conveyance direction of the first sheet conveyance path 3 and moreover located at a sheet-conveyance upstream end of the third sheet conveyance path 7. The third sheet conveyance path 7, having a plurality of conveyance roller pairs 7*r*, leads a sheet, which is under conveyance on the first sheet conveyance path 3, such that the sheet branches at the second branch portion 32 so as to be conveyed toward the third sheet discharge part 8.

The second branch portion 32 includes a second switching guide 321. The second switching guide 321 turns between a first position (see FIG. 5) in which a sheet conveyed on the first sheet conveyance path 3 from the sheet inlet 2 side is guided along the first sheet conveyance path 3 to the first discharge port 41, and a second position (not shown) in which the sheet, which is switched back after conveyance on the first sheet conveyance path 3 from the sheet inlet 2 side and passage through the second branch portion 32, is led to the third sheet conveyance path 7. The second switching guide 321 is connected to a drive mechanism (not shown) and controlled in its operation by the postprocessing control part 10.

The third sheet discharge part 8 is provided downward of the first sheet discharge part 4 (near a lower end portion of the sheet postprocessing device 1) and on the side face of the sheet postprocessing device 1 opposite to its side face facing the image forming apparatus 200. The third sheet discharge part 8 includes a third discharge port 81, a third discharge roller pair 82, and a third discharge tray 83.

The third discharge port 81 is located at a downstream end of the third sheet conveyance path 7 in the sheet conveyance direction. The third discharge roller pair 82 is placed at the third discharge port 81. The third discharge tray 83 is located on a downstream side of the third discharge port 81 in the sheet conveyance direction. A sheet conveyed on the third sheet conveyance path 7 and having reached the third discharge port 81 is discharged onto the third discharge tray 83 through the third discharge port 81 by the third discharge roller pair 82. The third discharge tray 83 is one of terminal discharge places for sheets subjected to postprocessing by the sheet postprocessing device 1.

The postprocessing part 9 performs specified postprocessing on a sheet subjected to image formation by the image forming apparatus 200 and conveyed into the sheet postprocessing device 1. The postprocessing part 9 includes the punching portion 91, a stapling portion 92, a sheet folding unit 100, and a bookbinding portion 94.

The punching portion 91 is placed in downstream-side close vicinity of the sheet inlet 2 in the first sheet conveyance path 3. The punching portion 91 performs a punching process on a sheet conveyed on the first sheet conveyance path 3, making a punch hole formed thereon.

The stapling portion 92 is placed in upstream-side close vicinity of the first sheet discharge part 4 as viewed in the sheet conveyance direction of the first sheet conveyance path 3. The stapling portion 92 performs a stapling process on a sheet bundle formed by stacking a plurality of sheets, by which the sheet bundle is stapled.

The sheet folding unit 100 is placed downstream of the punching portion 91 and upstream of the stapling portion 92, as viewed in the sheet conveyance direction of the first sheet conveyance path 3. In other words, the sheet folding unit 100 is located on an upstream side of the first branch portion 31, as viewed in the sheet conveyance direction of the first sheet conveyance path 3. The sheet folding unit 100 performs the folding process on one sheet to form a fold or folds thereon.

The sheet folding unit 100 is enabled to perform, for one sheet, such folding processes as two-folding, Z-folding, outward three-folding, and inward three-folding. A detailed configuration of the sheet folding unit 100 will be described later.

Figure 3A:
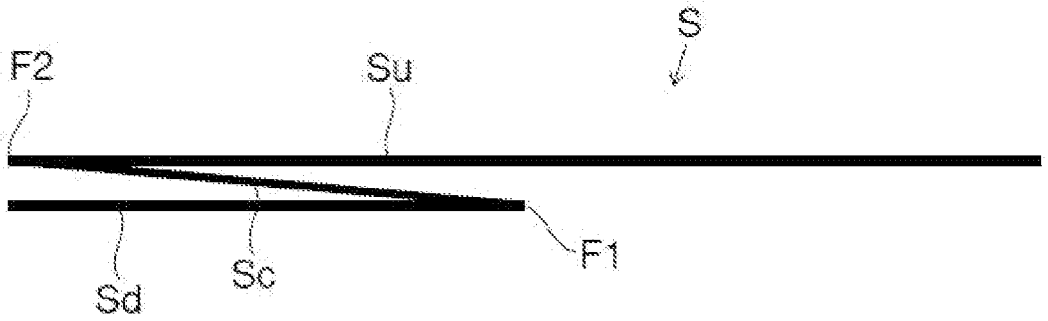
FIG. 3A is a side view of a sheet subjected to a folding process, where the sheet has been folded by Z-folding process.
Figure 3B:
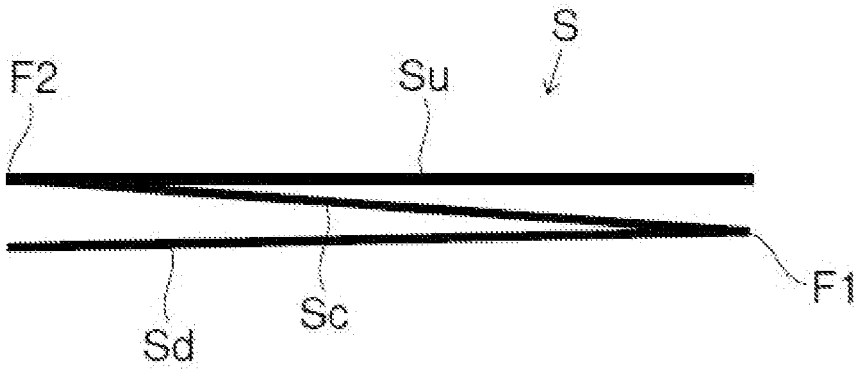
FIG. 3B is a side view of a sheet subjected to a folding process, where the sheet has been folded by outward-three-folding process.
Figure 3C:
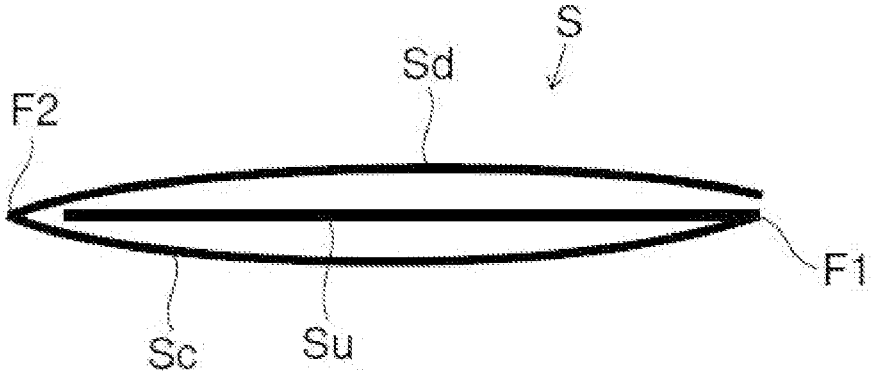
FIG. 3C is a side view of a sheet subjected to a folding process, where the sheet has been folded by inward-three-folding process.

FIGS. 3A to 3C are side views of sheets S subjected to the Z-folding process, the outward three-folding process, and the inward three-folding process, respectively.

The Z-folding, as shown in FIG. 3A as an example, is a way of folding in which a downstream side of a sheet S as viewed in the sheet conveyance direction of the first sheet conveyance path 3 is formed into a Z-like shape as viewed in a sheet widthwise direction perpendicular to the sheet conveyance direction. In the Z-folding, a downstream portion Sd of the sheet S located downstream of a first fold F1 in the first sheet conveyance path 3, and an upstream portion Su of the sheet S located upstream of a second fold F2 are up-and-down opposed to each other with an intermediate portion Sc interposed between the two folds. In the sheet conveyance direction, the downstream portion Sd and the intermediate portion Sc of the sheet S are generally equal in length to each other and shorter than the upstream portion Su.

The outward three-folding, as shown in FIG. 3B as an example, is a way of folding in which a sheet S as a whole is formed into a Z-like shape as viewed in the sheet widthwise direction. In the outward three-folding, a downstream portion Sd of the sheet S located downstream of a first fold F1 in the first sheet conveyance path 3, and an upstream portion Su located upstream of a second fold F2, are up-and-down opposed to each other with an intermediate portion Sc interposed between the two folds. In the sheet conveyance direction, the downstream portion Sd, the intermediate portion Sc and the upstream portion Su of the sheet S are generally equal in length to one another.

The inward three-folding, as shown in FIG. 3C as an example, is a way of folding in which an upstream portion Su of a sheet S located upstream of a first fold F1 as viewed in the sheet conveyance direction of the first sheet conveyance path 3, and a downstream portion Sd located downstream of a second fold F2 are up-and-down opposed to each other in their planar contact on one side (upper side in FIG. 3C) of a plane of an intermediate portion Sc between the two folds.

The bookbinding portion 94 is placed in upstream-side close vicinity of the third sheet discharge part 8 as viewed in the sheet conveyance direction of the third sheet conveyance path 7. The bookbinding portion 94 includes a middle-folding portion 941, a middle-stitching portion 942. The bookbinding portion 94 performs, on a sheet bundle formed by stacking a plurality of sheets, a middle-folding process and a middle-stitching process for folding and stitching a generally central portion of the sheet bundle in the sheet conveyance direction to make up a booklet.

The postprocessing control part 10 includes a CPU, a storage part, and other electronic circuits and electronic components (none are shown). The postprocessing control part 10 is communicatably connected to an apparatus control part of the image forming apparatus 200 (see FIG. 1). The postprocessing control part 10, receiving a command from the apparatus control part, controls operations of individual components provided in the sheet postprocessing device 1 based on control programs and data stored in the storage part with use of the CPU, by which the postprocessing control part 10 fulfills processes related to functions of the sheet postprocessing device 1. The first sheet conveyance path 3, the first sheet discharge part 4, the second sheet conveyance path 5, the second sheet discharge part 6, the third sheet conveyance path 7, the third sheet discharge part 8, and the postprocessing part 9, individually receiving commands from the postprocessing control part 10, perform postprocessing on a sheet in linkage with one another. It is noted that the functions of the postprocessing control part (control part) 10 may be fulfilled instead by the apparatus control part of the image forming apparatus 200 in addition to its own functions.

Figure 4:
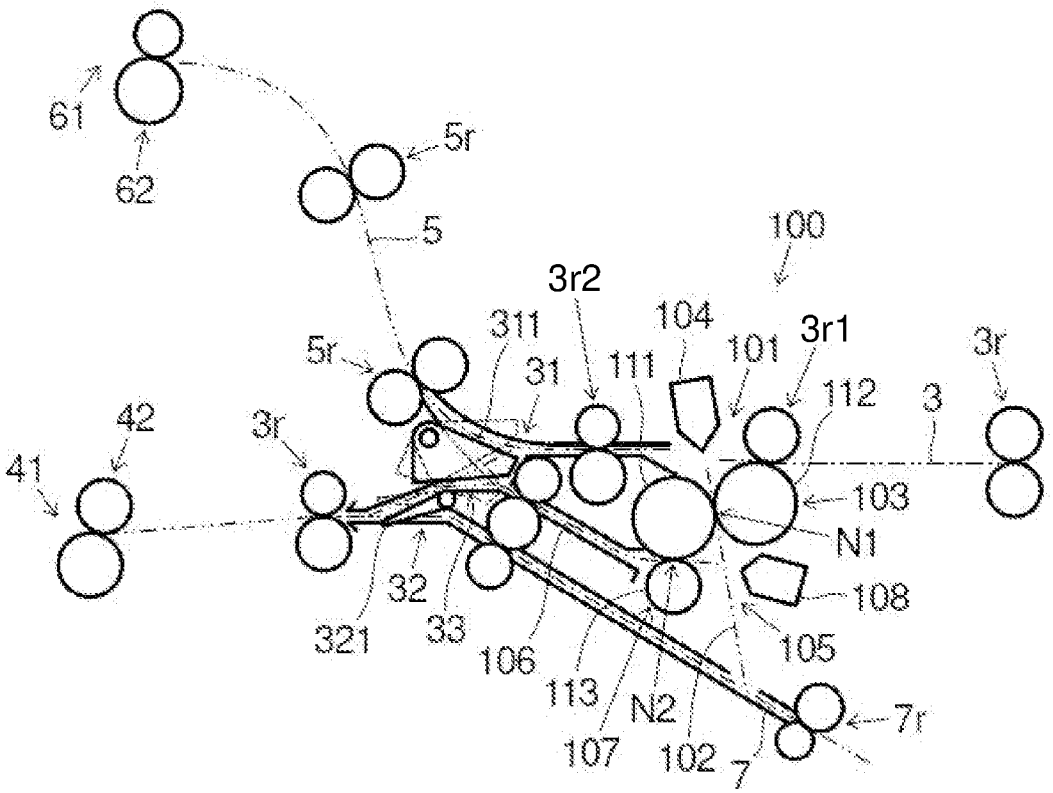
FIG. 4 is a partial sectional view of around a sheet folding unit in the sheet postprocessing device of FIG. 2.
Figure 5:
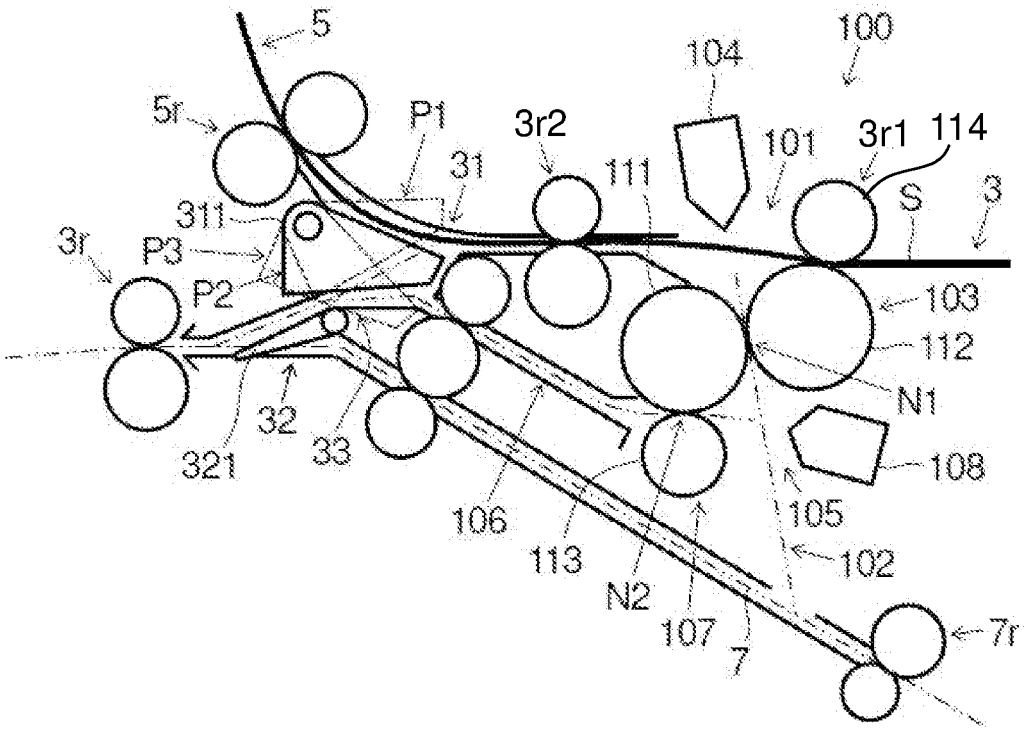
FIG. 5 is a sectional view of around the sheet folding unit, showing an initial stage of the sheet inward-three-folding process.

Subsequently, a configuration of the sheet folding unit 100 is described with reference to FIGS. 4 and 5. FIG. 4 is a partial sectional view of around the sheet folding unit 100 in the sheet postprocessing device 1 of FIG. 2. FIG. 5 is a sectional view of around the sheet folding unit 100 of FIG. 4. The sheet folding unit 100 includes a first folding portion 101, a first folding conveyance path 102, a first folding roller pair 103, a first folding guide 104, a second folding portion 105, a second folding conveyance path 106, a second folding roller pair 107, and a second folding guide 108.

Also, conveyance roller pairs 3*r* are placed, along the first sheet conveyance path 3, at two sites in the sheet folding unit 100. Hereinbelow, out of the conveyance roller pairs 3*r* placed at two sites in the sheet folding unit 100, an upstream-side conveyance roller pair 3*r* composed of a second roller 112 and a conveyance roller 114 is assumed as a first assist roller pair 3*r*1, and a downstream-side conveyance roller pair 3*r* is assumed as a second assist roller pair 3*r*2.

The first folding portion 101 is placed on the first sheet conveyance path 3. In more detail, the first folding portion 101 is located downstream of the punching portion 91 (see FIG. 2) and upstream of the first branch portion 31, as viewed in the sheet conveyance direction of the first sheet conveyance path 3.

The first folding conveyance path 102 branches from the first folding portion 101 on the first sheet conveyance path 3 and extends downward. In this embodiment, the first folding conveyance path 102 extends generally vertically downward from the first folding portion 101. A lower end portion of the first folding conveyance path 102 connects to the third sheet conveyance path 7.

The first folding roller pair 103 is placed on the first folding conveyance path 102 in the first folding portion 101. The first folding roller pair 103 is composed of a first roller 111 placed on one side of the first folding conveyance path 102, and the second roller 112 placed on the other side of the first folding conveyance path 102. In the first folding roller pair 103, one of the first roller 111 and the second roller 112 is biased toward the other into contact therebetween, causing a first folding nip portion N1 to be formed. A sheet that has entered the first folding conveyance path 102, passing through the first folding nip portion N1, is conveyed downward of the first folding roller pair 103.

In addition, the second roller 112 in combination with the conveyance roller 114 makes up the first assist roller pair 3*r*1.

The first folding guide 104 is placed opposite to the first folding nip portion N1 in the first folding portion 101. In more detail, the first folding guide 104 is placed upstream (upper side in FIG. 4) of the first folding nip portion N1 as viewed in the sheet conveyance direction of the first folding conveyance path 102. In a case where the sheet is subjected to no folding process, the first folding guide 104 retracts in such a direction as to become farther from the first folding nip portion N1 than the first sheet conveyance path 3, i.e., retracts upward of the first sheet conveyance path 3 as viewed in FIG. 4. As a result, the sheet passing through the first sheet conveyance path 3 keeps out of contact with the first folding guide 104.

The first folding guide 104 is connected to a guide drive mechanism (not shown) and enabled to reciprocate in such directions as to become closer to and farther from the first folding nip portion N1. The first folding guide 104 leads a sheet, which is under conveyance on the first sheet conveyance path 3, to the first folding nip portion N1.

The second folding portion 105 is placed on the first folding conveyance path 102. In more detail, the second folding portion 105 is located downstream of the first folding roller pair 103 as viewed in the sheet conveyance direction of the first folding conveyance path 102 and moreover downward of the first folding nip portion N1.

The second folding conveyance path 106 branches and extends from the second folding portion 105 on the first folding conveyance path 102. The second folding conveyance path 106 extends from the second folding portion 105 toward the side face (left side in FIG. 4) of the sheet postprocessing device 1 on which the first sheet discharge part 4 is provided. In other words, the second folding conveyance path 106 extends in a direction generally equal to a direction in which the first sheet conveyance path 3 extends.

The first sheet conveyance path 3 includes a merging portion 33 located downstream of the first branch portion 31 in the sheet conveyance direction. The second folding conveyance path 106 merges with the first sheet conveyance path 3 at the merging portion 33. In other words, the merging portion 33 is located downstream of the first branch portion 31 as viewed in the sheet conveyance direction of the first sheet conveyance path 3, and a sheet subjected a folding process by the sheet folding unit 100 merges together.

In this embodiment, the merging portion 33 is located in close vicinity to the first switching guide 311. The first switching guide 311 is switchable among a first position P1, a second position P2, and a third position P3 (see FIG. 5 for all these positions). The first switching guide 311 set in the first position P1 leads a sheet, which is under conveyance on the first sheet conveyance path 3 from the sheet inlet 2 side, to the first discharge port 41. The first switching guide 311 set in the second position P2 leads a sheet, which is under conveyance on the first sheet conveyance path 3, to the second sheet conveyance path 5. The first switching guide 311 set in the third position P3 leads a sheet, which is under conveyance on the second folding conveyance path 106, to the second discharge port 61 via the second sheet conveyance path 5.

The second folding roller pair 107 is placed on the second folding conveyance path 106 in the second folding portion 105. The second folding roller pair 107 is composed of the first roller 111 placed on one side of the second folding conveyance path 106 and a third roller 113 placed on the other side, with the second folding conveyance path 106 interposed therebetween. In the second folding roller pair 107, one of the first roller 111 and the third roller 113 is biased against the other into contact with each other, by which a second folding nip portion N2 is formed. A sheet that has entered the second folding conveyance path 106, passing through the second folding nip portion N2, is conveyed toward the merging portion 33 (leftward of the second folding roller pair 107 in FIG. 4).

The second folding guide 108 is placed opposite to the second folding nip portion N2 in the second folding portion 105. In more detail, the second folding guide 108 is placed upstream (right side in FIG. 4) of the second folding nip portion N2 as viewed in the sheet conveyance direction of the second folding conveyance path 106. In a case where the sheet is subjected to no folding process, the second folding guide 108 retracts in such a direction as to become farther from the second folding nip portion N2 than the first folding conveyance path 102, i.e., retracts rightward of the first folding conveyance path 102 as viewed in FIG. 4. As a result, a sheet passing through the first folding conveyance path 102 keeps out of contact with the second folding guide 108.

The second folding guide 108 is connected to a drive mechanism (not shown) and enabled to reciprocate in such directions as to become closer to and farther from the second folding nip portion N2. The second folding guide 108 leads a sheet, which is under conveyance on the first folding conveyance path 102, to the second folding nip portion N2.

Figure 6:
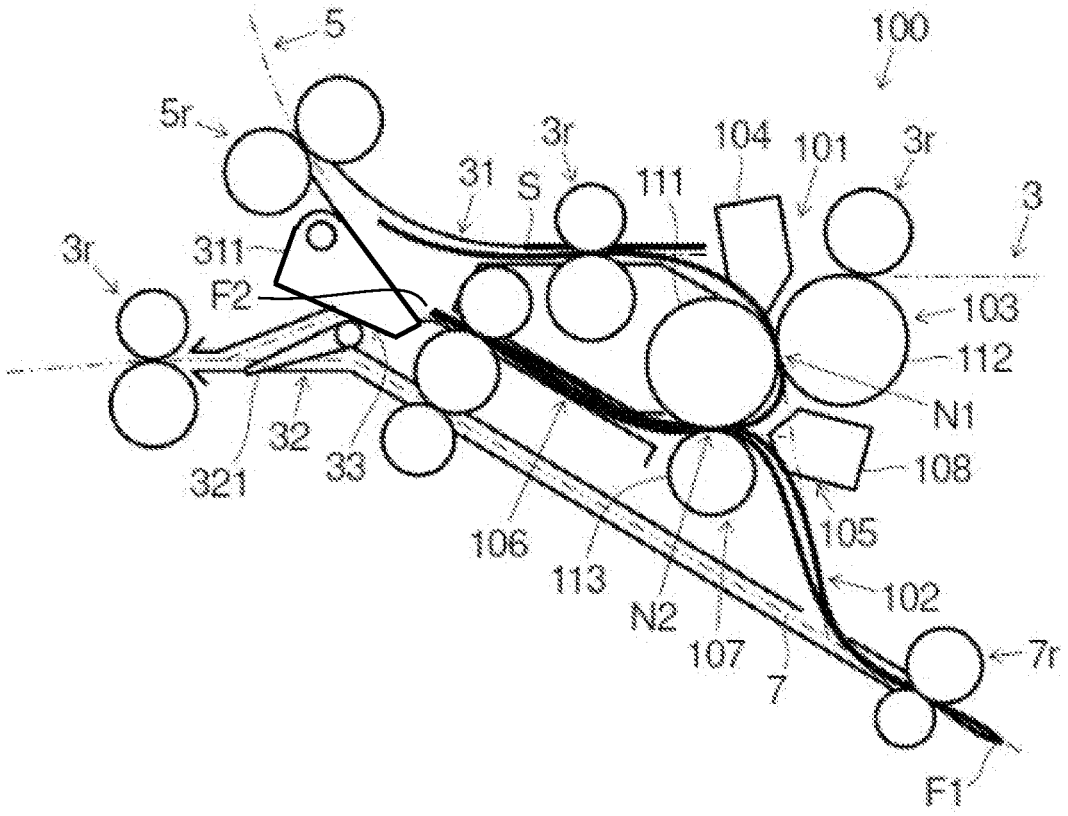
FIG. 6 is a sectional view of around the sheet folding unit, showing a final stage of the sheet inward-three-folding process.

Subsequently, operation of the sheet folding unit 100 is described with reference to FIGS. 5 and 6. The operation of the sheet folding unit 100 is described, as an example, about an inward three-folding process for making a sheet inwardly three-folded as shown in FIG. 3C. FIGS. 5 and 6 are sectional views of around the sheet folding unit 100 of FIG. 4, showing an initial stage and a final stage, respectively, in transition of the inward-three-folding process with the sheet S.

As shown in FIG. 5, a sheet S conveyed through the sheet inlet 2 (see FIG. 2) onto the first sheet conveyance path 3 has a downstream portion in the sheet conveyance direction thereof led from the first branch portion 31 onto the second sheet conveyance path 5. The first switching guide 311 of the first branch portion 31 is positioned in the second position P2 in which the sheet S conveyed from the sheet inlet 2 on the first sheet conveyance path 3 is led to the second sheet conveyance path 5.

In addition, in the first folding portion 101, the first folding guide 104 is placed at such a position (retract position) as to have retracted in a direction of becoming farther from the first folding nip portion N1 than the first sheet conveyance path 3, i.e., retracted upward of the first sheet conveyance path 3 as viewed in FIG. 5.

When a site of the sheet S corresponding to the first fold F1 (see FIG. 3C) has reached the first folding portion 101, it follows that the second assist roller pair 3*r*2, the first assist roller pair 3*r*1, and the individual conveyance roller pairs 5*r* of the second sheet conveyance path 5 are stopped from rotation, with the result that the sheet S is stopped from conveyance.

With the first assist roller pair 3*r*1 stopped, the second assist roller pair 3*r*2 and the conveyance roller pairs 5*r* of the second sheet conveyance path 5 are rotated reverse, so that a portion of the sheet S located on the downstream side of the first assist roller pair 3*r*1 is moved to the upstream side (right side in FIG. 5), causing a flexure to occur to the sheet S in the first folding portion 101. Thereafter, the first folding guide 104 starts to be moved from the retract position in such a direction as to get closer to the first folding nip portion N1.

The second assist roller pair 3*r*2 is further rotated reverse, and the first folding guide 104 is moved to such a position (folding position) as to come into contact with the first folding nip portion N1 via the sheet S. Movement of the first folding guide 104 from the retract position to the folding position causes the flexed portion of the sheet S to be guided to the first folding nip portion N1. Thus, making the first folding guide 104 moved to the folding position after the formation of a flexure in the sheet S makes it possible to suppress occurrence of creases or breaks of the sheet S because no excessive load due to the first folding guide 104 acts on the sheet S. The first fold F1 is formed in the sheet S that has passed through the first folding nip portion N1.

In addition, a timing for forming the first fold F1 in the sheet S is determined based on a detection timing of a downstream end of the sheet S, as viewed in the sheet conveyance direction of the first sheet conveyance path 3, by a sheet detection sensor (not shown), as well as based on an overall length of the sheet S in the sheet conveyance direction and a conveyance speed of the sheet S. The case is the same also with a timing for forming a later-described second fold F2.

In the second folding portion 105, the second folding guide 108 retracts in such a direction (right side of the first folding conveyance path 102 in FIG. 5) as to become farther from the second folding nip portion N2 than the first folding conveyance path 102.

The sheet S that has passed through the first folding nip portion N1 is conveyed in the first folding conveyance path 102 in such a direction (downward direction) as to become farther from the first folding roller pair 103 while the sheet S is headed by the first fold F1 site and its two regions extending along the sheet conveyance direction are overlapped with each other. An upstream portion of the sheet S in the sheet conveyance direction that has passed through the first folding conveyance path 102 temporarily enters the third sheet conveyance path 7.

When a site of the sheet S corresponding to the second fold F2 (see FIG. 3C) has reached the second folding portion 105, it follows that the second assist roller pair 3*r*2, the first assist roller pair 3*r*1, the individual conveyance roller pairs 5*r* of the second sheet conveyance path 5, the first folding roller pair 103, and the individual conveyance roller pairs 7*r* of the third sheet conveyance path 7 are stopped from rotation, with the result that the sheet S is stopped from conveyance.

After the sheet S has been stopped from conveyance, the individual conveyance roller pairs 7*r* of the third sheet conveyance path 7 are rotated reverse, so that a downstream side (a side lower than the second folding portion 105 in FIG. 5) portion of the sheet S in the sheet conveyance direction of the second folding portion 105 is moved to the upstream side (upper side in FIG. 5), causing a flexure to occur to the sheet S at the site of the second folding portion 105.

Subsequently, the second folding guide 108 is moved in such a direction as to become closer to the second folding nip portion N2, coming into contact with the sheet S. The contact of the second folding guide 108 causes the flexure portion of the sheet S to be guided to the second folding nip portion N2 of the second folding roller pair 107. Then, a second fold F2 is formed in the sheet S that has passed through the second folding nip portion N2 (see FIG. 6).

As shown in FIG. 6, the sheet S that has passed through the second folding nip portion N2 is conveyed in the second folding conveyance path 106 in such a direction as to become farther from the second folding roller pair 107 while the sheet S is headed by the second fold F2 site and its three regions extending along the sheet conveyance direction are overlapped with one another. An upstream portion of the sheet S in the sheet conveyance direction having passed through the second folding conveyance path 106 enters the merging portion 33. In this case, in the merging portion 33, the sheet S is guided to the second sheet conveyance path 5 by the first switching guide 311 set in the third position P3, passing through the second discharge port 61 so as to be discharged to the second sheet discharge part 6 (see FIG. 2).

In a case where a sheet S is subjected to a folding process by the sheet folding unit 100, the postprocessing control part 10 leads a downstream portion of the sheet S in the sheet conveyance direction, which has been conveyed through the sheet inlet 2 into the first sheet conveyance path 3, from the first branch portion 31 to the second sheet conveyance path 5, then reverses the conveyance direction of the sheet S and leads the sheet S to the sheet folding unit 100, where the sheet S is subjected to the folding process. Further, the postprocessing control part 10 merges the sheet S, which has been subjected to the folding process, with the second sheet conveyance path 5 at the merging portion 33.

The above description has been made on the inward three-folding process with the sheet S. Also for the Z-folding process in which the sheet S is subjected to Z-folding shown in FIG. 3A as well as for the outward three-folding process in which the sheet S is subjected to outward three-folding shown in FIG. 3B, procedures shown in FIGS. 5 and 6 may be applied absolutely similarly by changing the timings for forming the first fold F1 and the second fold F2 in the sheet S.

Figure 7:
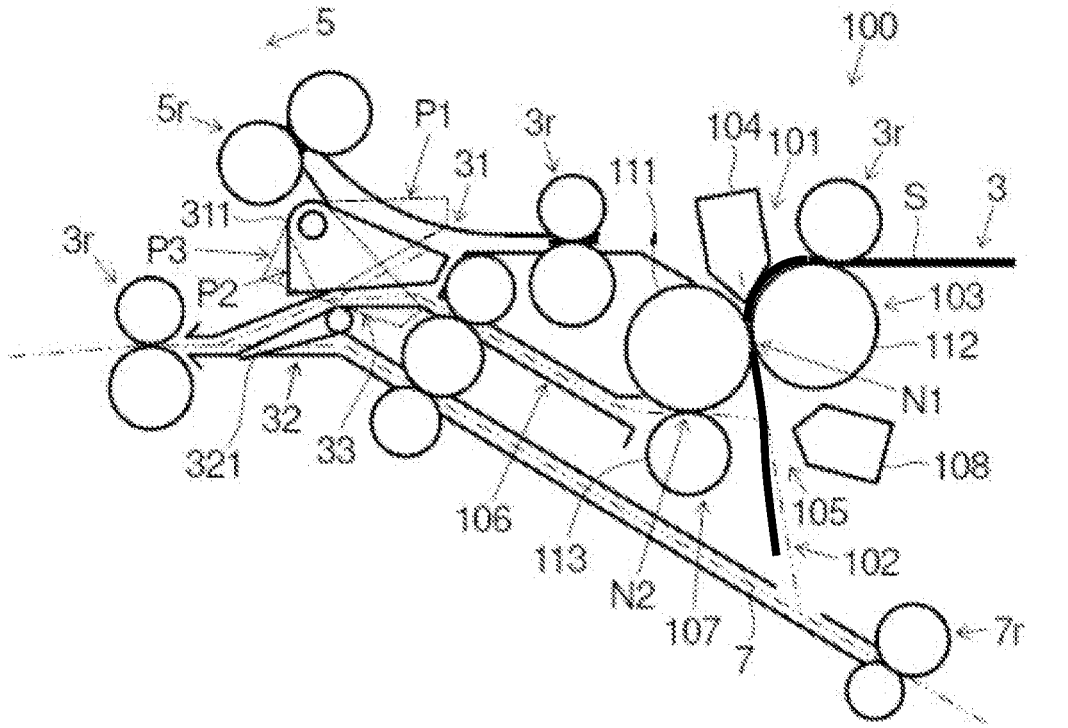
FIG. 7 is a sectional view of around the sheet folding unit, showing an initial stage of a sheet two-folding process.

FIG. 7 is a sectional view of around the sheet folding unit 100, showing an initial stage of a two-folding process with a sheet S. In a case where the sheet S is subjected to two-folding, the sheet S is conveyed into the sheet folding unit 100 with the first folding guide 104 set in the folding position. As a result, a fore end of the sheet S is guided to the first folding nip portion N1 along the first folding guide 104 and the second roller 112. Next, the sheet S is stopped at a position in which a center of the sheet S faces the second folding nip portion N2 of the second folding roller pair 107. In this state, the second folding guide 108 is moved in a direction of approaching the second folding nip portion N2 so as to be brought into contact with the sheet S, by which the center of the sheet S is guided to the second folding nip portion N2 of the second folding roller pair 107. As a result, a fold is formed in the sheet S that has passed through the second folding nip portion N2, thus the two-folding process being executed. The two-folded sheet S is guided to the second sheet conveyance path 5 by the first switching guide 311 set in the third position P3, and passes through the second discharge port 61 so as to be discharged to the second sheet discharge part 6 (see FIG. 2).

Figure 8:
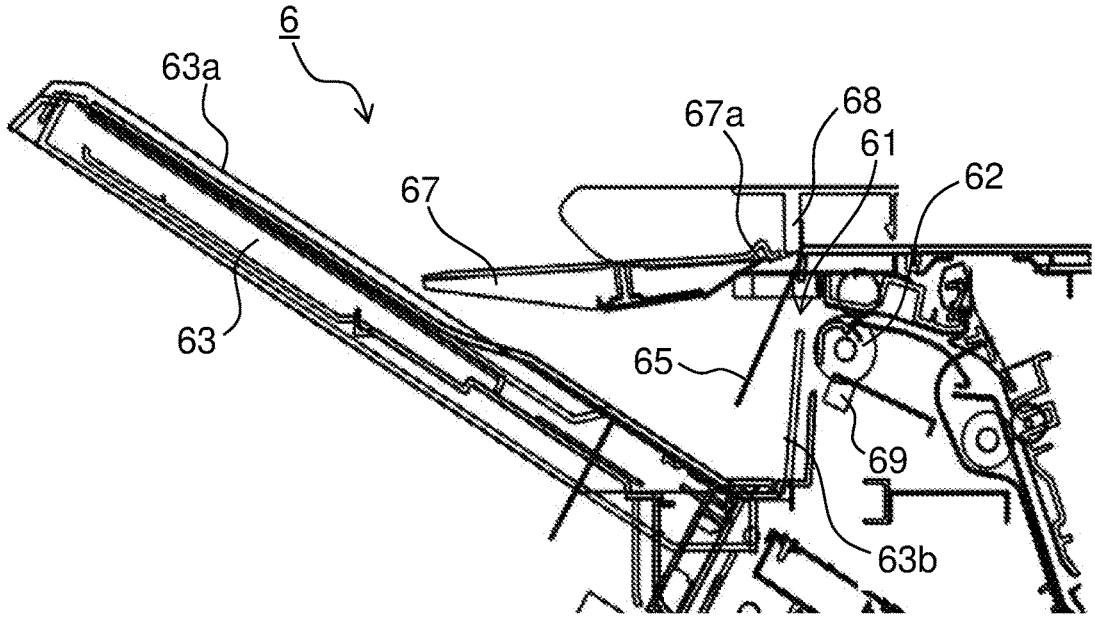
FIG. 8 is a side sectional view of around the second sheet discharge part of the sheet postprocessing device.
Figure 9:
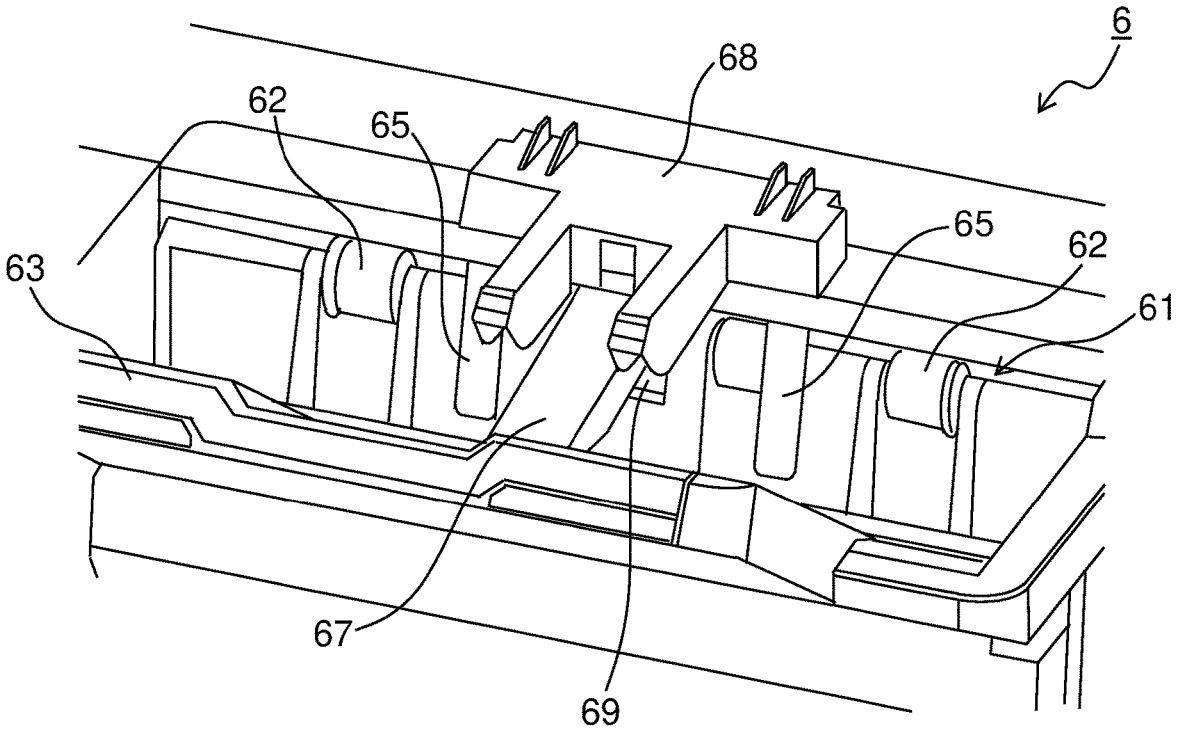
FIG. 9 is a perspective view of around the second sheet discharge part as seen from above.

FIG. 8 is a side sectional view of around the second sheet discharge part 6 of the sheet postprocessing device 1. FIG. 9 is a perspective view of around the second sheet discharge part 6 as seen from above. The second sheet discharge part 6 includes a second discharge roller pair 62, a second discharge tray 63 (sheet discharge tray), a first sheet presser member 65, and a second sheet presser member 67.

The second discharge tray 63 includes a tray upper surface 63*a* on which sheets subjected to a folding process by the sheet folding unit 100 and discharged through the second discharge port 61 (hereinafter, those sheets will be referred to as folded sheets) are to be stacked, and a rear wall portion 63*b* rising from a downstream-side end portion of the tray upper surface 63*a* in a discharge direction.

The first sheet presser member 65 has one end portion (base end portion) fixed upward of the second discharge roller pair 62, and the other end portion (fore end portion 65*a*) extending downward of the second discharge roller pair 62. The first sheet presser member 65 is brought into contact with a folded sheet discharged through the second discharge port 61 so as to press a portion of sheets stacked on the tray upper surface 63*a* of the second discharge tray 63, the pressed portion generally ranging from upstream-side end portion to central portion of the stacked sheets in the discharge direction.

The first sheet presser member 65 is an elastically deformable sheet-like member. The first sheet presser member 65 is elastically deformed in response to a stack number of folded sheets stacked on the tray upper surface 63*a*, causing a pressing portion of folded sheets to be varied. As a material of the first sheet presser member 65, polyethylene terephthalate (PET) films having a thickness of 0.2 to 0.3 mm may be mentioned as an example.

The first sheet presser member 65 may be formed from a platy member that is swingable by its self weight along the sheet discharge direction (from-right leftward direction in FIG. 8). In this case, the first sheet presser member 65 swings in response to the stack number of folded sheets stacked on the tray upper surface 63*a*, causing the pressing portion of folded sheets to be varied.

The second sheet presser member 67 presses a portion of a folded sheet discharged and stacked on the tray upper surface 63*a* of the second discharge tray 63, the pressed portion generally ranging from downstream-side fold portion to central portion of the stacked sheet in the discharge direction. The second sheet presser member 67 is swingably supported by a rotational fulcrum 67*a* provided downstream of the first sheet presser member 65 in the discharge direction. The second sheet presser member 67 swings toward the downstream side (in a clockwise direction in FIG. 8) or upstream side (in a counterclockwise direction in FIG. 8) in the sheet discharge direction in response to the stack number of folded sheets stacked on the tray upper surface 63*a*. As a result of this, the second sheet presser member 67 presses a vicinity of the fold of folded sheets stacked on the tray upper surface 63*a* without intercepting the discharge of folded sheets from the second discharge port 61 to the second discharge tray 63.

The first sheet presser member 65 and the second sheet presser member 67 are retained by a retaining member 68. The retaining member 68 is attachable to and detachable from the second sheet discharge part 6. The first sheet presser member 65 and the second sheet presser member 67 are attachable to and detachable from the second sheet discharge part 6 integrally together with the retaining member 68.

The second sheet discharge part 6 includes a fullness detection sensor 69. The fullness detection sensor 69 is placed at a site inside (upstream side in the discharge direction) a rear wall surface 63*b* of the second discharge tray 63 and nearly immediately under the second discharge roller pair 62 to detect a full state of folded sheets stacked on the tray upper surface 63*a*. The fullness detection sensor 69, while in a detection position in a widthwise direction perpendicular to the discharge direction, has a detection region R (see FIG. 10) having a specified width in a heightwise direction.

The fullness detection sensor 69 is a reflection-type PI (photointerrupter) sensor equipped with a detection part including a light-emitting portion and a light-receiving portion. When the stack quantity of folded sheets stacked on the tray upper surface 63*a* has come to a certain number of sheets (e.g., 30 sheets) or more, a stacking surface (top surface) of folded sheets reaches the detection region R of the fullness detection sensor 69. In this state, the detection part of the fullness detection sensor 69 is enabled to detect reflected light from folded sheets, so that the fullness detection sensor 69 detects a full state of folded sheets stacked on the tray upper surface 63*a*.

Figure 10:
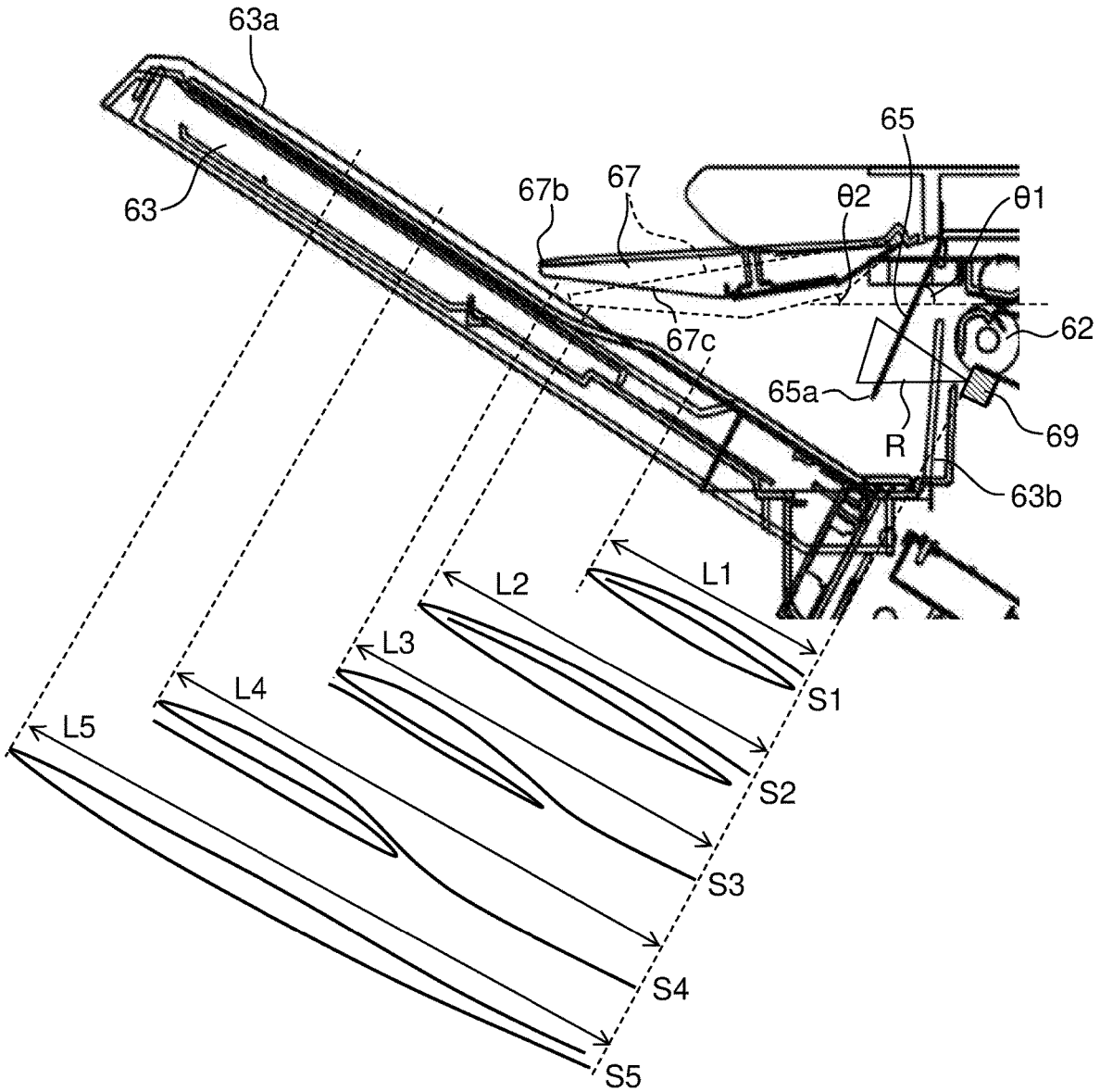
FIG. 10 is a view showing a correlation between sizes of folded sheets stacked on a second discharge tray and pressing positions of a first sheet presser member as well as a second sheet presser member.

FIG. 10 is a view showing a correlation between sizes of folded sheets stacked on the tray upper surface 63*a* and pressing positions of the first sheet presser member 65 and the second sheet presser member 67. In this embodiment, five types S1 to S5 of folded sheets are discharged through the second discharge port 61 and stacked on the second discharge tray 63.

A folded sheet S1 is obtained by inwardly three-folding (see FIG. 3C) a sheet of A4R size. A size L1 in the discharge direction of the folded sheet S1 is 102 mm. A folded sheet S2 is obtained by inwardly three-folding a sheet of A3 size. A size L2 in the discharge direction of the folded sheet S2 is 140 mm.

A folded sheet S3 is obtained by Z-folding (see FIG. 3A) a sheet of A4 size. A size L3 in the discharge direction of the folded sheet S3 is 148.5 mm. A folded sheet S4 is obtained by Z-folding a sheet of A3 size. A size L4 in the discharge direction of the folded sheet S4 is 210 mm. A folded sheet S5 is obtained by two-folding a sheet of 13 inch size. A size L5 in the discharge direction of the folded sheet S5 is 241.3 mm.

The first sheet presser member 65 presses a rear end portion of a folded sheet that has reached the detection region R of the fullness detection sensor 69, thereby securing the stack quantity of folded sheets stacked on the second discharge tray 63. The first sheet presser member 65 presses an arbitrary position within a range from central portion in the discharge direction to the rear wall portion 63*b* (a range of 50 mm distance from the rear wall portion 63*b*) in the folded sheet S1 of the minimum size stacked on the tray upper surface 63*a* of the second discharge tray 63. Also, in a first pressing position in which the fore end portion 65*a* protrudes downward of a lower limit of the detection region R (inside of a triangle in FIG. 10) of the fullness detection sensor 69, the first sheet presser member 65 presses, by its fore end portion 65*a*, a swell of the folded sheet S1. When the stack number of folded sheets S1 to S5 stacked on the tray upper surface 63*a* has exceeded a specified number of sheets, the first sheet presser member 65 is displaced upward by an ascent of the stack surface (upper surface) of the folded sheets S1, so that the first sheet presser member 65 retracts from the first pressing position, permitting the stack surface of the folded sheets S1 to S5 to ascend.

As a consequence, the first sheet presser member 65 is enabled to securely press a vicinity of the rear end portion of three-folded sheets S1 and S2, which would get swollen largely on their rear end side. Accordingly, the stack quantity of folded sheets S1 and S2 stacked on the second discharge tray 63 can be secured by avoiding misdetections of the fullness detection sensor 69 due to rear-end-side swells of the folded sheets S1 and S2. Also, occurrence of slip-in of folded sheets due to blockage of the second discharge port 61 by the rear end portion of the folded sheets S1 to S5 is suppressed by the pressing of a vicinity of the rear end portion of folded sheets S1 to S5. As a result, stackability of the folded sheets S1 to S5 can be improved.

In addition, there is a fear that collision loads against the first sheet presser member 65 may cause rounding or jamming of folded sheets S1 to S5 discharged from the second discharge port 61. Accordingly, a collision angle θ1 between the first sheet presser member 65 and a fore end of folded sheets S1 to S5 discharged from the second discharge port 61 is preferably set to 85° or less under a condition that no external force is applied to the first sheet presser member 65 (in the initial position).

By pressing a vicinity of folds in fore end portions of folded sheets S1 to S5 stacked on the tray upper surface 63*a*, the second sheet presser member 67 secures the stack quantity of folded sheets S1 to S5 on the tray upper surface 63*a*. A fore end portion 67*b* of the second sheet presser member 67 presses an arbitrary position within a range from central portion in the discharge direction of the folded sheet S5 of the maximum size stacked on the tray upper surface 63*a* to fore-end-side fold portion in the discharge direction of the folded sheet S1 of the minimum size (a range of 100 to 140 mm distance from the rear wall portion 63*b*). Also, in a second pressing position in which the fore end portion 67*b* protrudes downward of the lower limit of the detection region R of the fullness detection sensor 69, the second sheet presser member 67 presses a swell of folded sheets S1 to S5. When the stack number of folded sheets S1 to S5 has exceeded a specified number of sheets, the second sheet presser member 67 is rocked upward by an ascent of the stack surface (upper surface) of the folded sheets S1 to S5, so that the second sheet presser member 67 retracts from the second pressing position, permitting the stack surface of the folded sheets S1 to S5 to ascend.

As a consequence, the second sheet presser member 67 is enabled to securely press a vicinity of a fold of Z-folded sheets S3 and S4, which would get swollen largely on their fore end side. Accordingly, the stack quantity of folded sheets S3 to S5 stacked on the second discharge tray 63 can be secured by avoiding misdetections of the fullness detection sensor 69 due to fore-end-side swells of the folded sheets S3 and S4. Also, occurrence of push-out of folded sheets due to subsequent folded sheets S1 to S5 is suppressed by the pressing of central portion to fore end portion of the folded sheets S1 to S5 in the discharge direction already stacked on the second discharge tray 63. As a result, alignment of the folded sheets S1 to S5 in the discharge direction and the widthwise direction can be improved.

In this connection, in a case where the second sheet presser member 67 is so placed that the fore end portion 67*b* of the second sheet presser member 67 presses a vicinity of a fold of folded sheets S3 and S4, it becomes impossible for the fore end portion 67*b* of the second sheet presser member 67 to press a fold portion on the fore end side of the folded sheet S1 of the minimum size. Therefore, a sloped surface 67*c* which is sloped from the fore end portion 67*b* in such a direction as to become closer to the tray upper surface 63*a* is formed at a lower surface of the second sheet presser member 67. In more detail, the sloped surface 67*c* is sloped in such a direction as to become farther and farther from an upper surface of the second sheet presser member 67 as a distance from the fore end portion 67*b* increases more and more toward the upstream side (right side in FIG. 10) of the sheet discharge direction. As a result, with a plurality of folded sheets S1 stacked on the tray upper surface 63*a*, the sloped surface 67*c* of the second sheet presser member 67 comes into contact with a fold portion on the fore end side of the folded sheet S1. As a consequence, swells of folded sheets S1 on the fore end side can be suppressed.

In addition, there is a fear that collision loads against the second sheet presser member 67 may cause rounding or jamming of folded sheets discharged from the second discharge port 61. Accordingly, a collision angle θ2 between the second sheet presser member 67 and a fore end of folded sheets S1 to S5 discharged from the second discharge port 61 is preferably set to 40° or less under a condition that the fore end portion 67*b* of the second sheet presser member 67 is positioned in contact with the second discharge tray 63 (initial position, broken-line position in FIG. 10).

Although an embodiment of the present disclosure has been described hereinabove, the scope of the disclosure is not limited to this, and various modifications and changes may be made unless departing from the gist of the invention. For example, the above-described embodiment has been described on a case where the sheet folding unit 100 includes the first folding roller pair 103, and the second folding roller pair 107, which is composed of three rollers of the first roller 111 to the third roller 113. However, the disclosure is not limited to this, and the sheet folding unit 100 may include only the first folding roller pair 103 composed of the first roller 111 and the second roller 112.

Further, in the above embodiment, sheets subjected to a folding process by the sheet folding unit 100 are discharged to the second sheet discharge part 6. Alternatively, sheets subjected to a folding process may be discharged instead to the first sheet discharge part 4. In this case, the first sheet presser member 65 and the second sheet presser member 67 may appropriately be placed in the first sheet discharge part 4.

Furthermore, in the above embodiment, the sheet discharge device of the disclosure has been exemplified by the second sheet discharge part 6 of the sheet postprocessing device 1 including the sheet folding unit 100 by which sheets are subjected to the folding process. However, the disclosure is not limited to this. For example, the disclosure may be applied similarly to a sheet discharge part of a sheet postprocessing device 1 which includes no sheet folding unit 100 and into which folded sheets subjected to the folding process by a separately provided sheet folding device are to be conveyed.

The present disclosure is applicable to sheet discharge devices for discharging sheets subjected to a folding process of forming a fold in the sheets, as well as to postprocessing devices each including such a sheet discharge device.

What is claimed is:

1. A sheet discharge device comprising:

a sheet discharge part including a discharge roller pair for discharging a folded sheet subjected to a folding process;

a sheet discharge tray including a tray upper surface on which the folded sheet discharged from the sheet discharge part is stacked, and a rear wall portion rising from a upstream-side end portion of the tray upper surface in the discharge direction;

a fullness detection sensor which is provided in the sheet discharge part to detect that a height of a stack surface of the folded sheets stacked on the tray upper surface has reached a specified height;

a first sheet presser member which is supported upward of the sheet discharge part and extends toward the upstream side of the tray upper surface in the discharge direction, and with which the folded sheet discharged from the sheet discharge part is brought into contact, and which presses a rear end side of the folded sheet in the discharge direction stacked on the tray upper surface; and a second sheet presser member which is supported upward of the sheet discharge part and extends toward a downstream side of the tray upper surface in the discharge direction, and which presses a fore end side of the folded sheet in the discharge direction stacked on the tray upper surface, wherein the fullness detection sensor which is located in a detection position in a widthwise direction perpendicular to the discharge direction, has a detection region which has a specified width in a heightwise direction, and the first sheet presser member is disposed outside the fullness detection sensor in the widthwise direction, extends from above the detection sensor to below the detection region, and in a first pressing position with a fore end portion of the first sheet presser member facing upward of the stack surface, is brought into contact with an arbitrary position in a range from a central portion of the folded sheet of a minimum size in the discharge direction stacked on the tray upper surface to the rear wall portion, thereby pressing a swell of the folded sheet, and when a stack number of the folded sheets has exceeded a specified number, the first sheet presser member is retracted upward from the first pressing position by the rise of the stack surface.

2. The sheet discharge device according to claim 1, wherein in an initial state in which no external force is applied to the first sheet presser member, a collision angle between the first sheet presser member and a leading end of the folded sheet discharged from the sheet discharge part is 85° or less.

3. The sheet discharge device according to claim 1, wherein the second sheet presser member, in a second pressing position in which the second sheet presser member extends downward beyond the detection region, is brought into contact with an arbitrary position in a range between a central portion of the folded sheet of a maximum size in the discharge direction stacked on the sheet stack surface and on a leading end of the folded sheet of the minimum size in the discharge direction, thereby pressing a swell of the folded sheet, and when the stack number of the folded sheets has exceeded a specified number, the second sheet presser member is retracted upward from the second pressing position by the rise of the stack surface.

4. The sheet discharge device according to claim 3, wherein in an initial state with no external force applied, the second sheet presser member is brought into contact with the folded sheet discharged from the sheet discharge part on a downstream side of the first sheet presser member, and in the initial state with a fore end portion of the second sheet presser member in contact with the tray upper surface, a collision angle between the second sheet presser member and a fore end of the folded sheet discharged from the sheet discharge part is 40° or less.

5. The sheet discharge device according to claim 1, wherein the first sheet presser member is an elastically deformable member.

6. The sheet discharge device according to claim 1, wherein the second sheet presser member is a rigid member swingable along a sheet discharge direction.

7. The sheet discharge device according to claim 6, wherein at a lower surface of the second sheet presser member, a sloped surface is formed so as to be sloped in such a direction as to become farther and farther from an upper surface of the second sheet presser member as a distance from a fore end portion of the second sheet presser member increases more and more toward an upstream side of the sheet discharge direction.

8. The sheet discharge device according to claim 1, wherein the first sheet presser member includes a pair of first sheet presser members disposed on both sides of the detection position in the widthwise direction, and the second sheet presser member is disposed between the pair of first sheet presser members and swingably supported by a rotational fulcrum provided downstream of the pair of first sheet presser members in the discharge direction.

9. The sheet discharge device according to claim 1, further comprising a retaining member configured to retain the first sheet presser member and the second sheet presser member, wherein the retaining member is attachable to and detachable from the sheet discharge part.

10. The sheet discharge device according to claim 1, wherein the first sheet presser member is brought into contact with a vicinity of a rear end portion of the folded sheet subjected to three-folding process, thereby pressing a swell of the folded sheet.

11. A sheet postprocessing device comprising:

a folding unit configured to subject a sheet to a specified folding process; and the sheet discharge device according to claim 1 provided on a downstream side of the folding unit in a conveyance direction of the sheet.

12. A sheet discharge device comprising:

a sheet discharge part including a discharge roller pair for discharging a folded sheet subjected to a folding process;

a sheet discharge tray including a tray upper surface on which the folded sheet discharged from the sheet discharge part is stacked, and a rear wall portion rising from a upstream-side end portion of the tray upper surface in the discharge direction;

a fullness detection sensor which is provided in the sheet discharge part to detect that a height of a stack surface of the folded sheets stacked on the tray upper surface has reached a specified height;

a first sheet presser member which is supported upward of the sheet discharge part and extends toward the upstream side of the tray upper surface in the discharge direction, and with which the folded sheet discharged from the sheet discharge part is brought into contact, and which presses a rear end side of the folded sheet in the discharge direction stacked on the tray upper surface; and a second sheet presser member which is supported upward of the sheet discharge part and extends toward a downstream side of the tray upper surface in the discharge direction, and which presses a fore end side of the folded sheet in the discharge direction stacked on the tray upper surface, wherein the fullness detection sensor is located at a specified detection position in a widthwise direction perpendicular to the discharge direction and has a detection region which has a specified width in a heightwise direction, and the first sheet presser member is disposed outside the fullness detection sensor in the widthwise direction, extends from a point upward of the discharge roller pair to another point downward of the detection region, and in a first pressing position with a fore end portion of the first sheet presser member facing upward of the stack surface, is brought into contact with an arbitrary position within a range from central portion of the folded sheet in the discharge direction stacked on the tray upper surface to the rear wall portion, thereby pressing a swell of the folded sheet, and the first sheet presser member is displaced upward in response to an ascent of the stack surface of the folded sheets, and when a stack number of the folded sheets has exceeded a specified number, the fore end portion retracts upward from the first pressing position.

13. The sheet discharge device according to claim 12, wherein the second sheet presser member, in a second pressing position in which the second sheet presser member extends to a point downward of the detection position, its fore end portion is brought into contact with the folded sheet at an arbitrary position on the downstream side from the central portion of the sheet stack surface in the discharge direction, thereby pressing a swell of the folded sheet, and the second sheet presser member is displaced upward in response to an ascent of the stack surface of the folded sheets, and when a stack number of the folded sheets has exceeded a specified number, the fore end portion retracts upward from the second pressing position.

* * * * *